US011896065B2

(12) United States Patent
Smith et al.

(10) Patent No.: US 11,896,065 B2
(45) Date of Patent: Feb. 13, 2024

(54) PERSONAL TEMPERATURE REGULATION DEVICE

(71) Applicant: Zero Degrees, LLC, Austin, TX (US)

(72) Inventors: Christopher D. Smith, Austin, TX (US); John P. Vacalis, Austin, TX (US)

(73) Assignee: Zero Degrees, LLC, Austin, TX (US)

( * ) Notice: Subject to any disclaimer, the term of this patent is extended or adjusted under 35 U.S.C. 154(b) by 0 days.

(21) Appl. No.: 17/345,410

(22) Filed: Jun. 11, 2021

(65) Prior Publication Data

US 2021/0386130 A1 Dec. 16, 2021

Related U.S. Application Data

(60) Provisional application No. 63/038,369, filed on Jun. 12, 2020.

(51) Int. Cl.
*A41D 13/005* (2006.01)
*A41B 3/00* (2006.01)

(52) U.S. Cl.
CPC ..... *A41D 13/0058* (2013.01); *A41B 3/00* (2013.01)

(58) Field of Classification Search
CPC ..... A41D 13/0058; A41D 20/005; A41D 2023/002; A41D 2023/004; A61F 2007/0238; A61F 2007/0233; A61F 2007/0225; A61F 2007/023; A61F 2007/0231
See application file for complete search history.

(56) References Cited

U.S. PATENT DOCUMENTS 2,562,121 A * 7/1951 Poux ..... A61F 7/02
165/DIG. 45
2,620,478 A * 12/1952 Fraum ..... A41D 23/00
D2/605

(Continued)

FOREIGN PATENT DOCUMENTS

WO WO-9428836 A1 * 12/1994 ..... A61F 7/10
WO WO-0203897 A1 * 1/2002 ..... A61F 7/10

OTHER PUBLICATIONS www.amazon.com/Sports-Laboratory-Integrated-Adjustable-Cervical/dp/B07KWF9253?th=1 Sports Laboratory Ice Pack for Neck Relief-Neck Support Brace with Hot & Cold Therapy Pack Date First Available: Sep. 2019 (Year: 2019).*

*Primary Examiner* — Alissa L Hoey
(74) *Attorney, Agent, or Firm* — Meunier Carlin & Curfman LLC

(57) ABSTRACT

A tubular collar adapted to be worn around the neck of an individual. The tubular collar has a front sheet and a rear sheet, each with tapered ends. A fastener is provided on opposite ends of the front and rear sheets. The tubular collar is configurable in an open configuration and a closed configuration. In the closed configuration, the fasteners are attached to each other to affix the tapered ends together to form a loop sized to be placed around the neck of an individual. The tubular collar comprises an opening on the front sheet sized to receive ice or other cooling medium, or a heating medium, within an enclosed space of the tubular collar. By positioning the tubular collar around the neck, the weight of the cooling or heating medium is distributed across the neck and shoulders thereby providing comfort during motion such as during strenuous activities.

20 Claims, 3 Drawing Sheets

(56) References Cited

U.S. PATENT DOCUMENTS 2,796,903 A * 6/1957 Gazelle ..... A61F 7/103 607/109
2,832,075 A * 4/1958 Davidson ..... A41D 23/00 2/91
3,628,537 A * 12/1971 Berndt ..... A61D 9/00 602/14
4,446,574 A * 5/1984 Kalomeris ..... A45C 1/04 2/338
4,641,655 A * 2/1987 Abt ..... A61F 7/10 607/109
4,645,498 A * 2/1987 Kosak ..... A61F 7/02 604/289
4,742,581 A * 5/1988 Rosenthal ..... A41D 20/005 2/200.1
5,133,348 A * 7/1992 Mayn ..... A61F 7/10 607/108
5,247,928 A * 9/1993 Stilts, Jr. ..... A61F 7/03 607/114
5,265,669 A * 11/1993 Schneider ..... A61F 7/02 62/530
D342,790 S * 12/1993 Zona ..... D24/207
5,274,865 A * 1/1994 Takehashi ..... A61F 7/10 5/643
5,295,949 A * 3/1994 Hathaway ..... A63B 23/025 602/14
5,400,617 A * 3/1995 Ragonesi ..... F25D 3/08 62/530
5,423,875 A * 6/1995 Kehe ..... A61F 7/10 607/114
5,458,628 A * 10/1995 Cipolla ..... A61F 7/02 607/114
5,507,793 A * 4/1996 Hodges ..... A61F 7/02 607/114
5,572,745 A * 11/1996 Mainus ..... A61F 9/045 2/171.2
5,597,577 A * 1/1997 Mathewson ..... F25D 5/00 424/402
6,123,717 A * 9/2000 Davis ..... A61F 7/03 607/114
6,185,750 B1 * 2/2001 Dumas ..... A61F 7/103 2/209.12
6,554,787 B1 * 4/2003 Griffin ..... A61H 23/00 602/17
6,972,029 B2 * 12/2005 Mayrhofer ..... A61F 7/02 607/108
7,275,269 B2 * 10/2007 Skillman ..... A41D 23/00 2/468
D610,693 S * 2/2010 Thomas ..... D24/206
D627,893 S * 11/2010 Weiss ..... D24/191
D635,268 S * 3/2011 Sagnip ..... D24/191
D641,488 S * 7/2011 Mori ..... D24/206
D655,420 S * 3/2012 Bowles ..... D24/206
D695,902 S * 12/2013 Daniels ..... D24/206
8,627,788 B2 * 1/2014 Sebo ..... A01K 27/002 54/79.2
8,876,875 B1 * 11/2014 Nilforushan ..... A61H 1/008 607/108
9,241,522 B2 * 1/2016 Branson ..... A41D 23/00
D779,779 S * 2/2017 Clark ..... D2/500
10,021,926 B2 * 7/2018 Stevenson ..... A41D 20/005
D827,844 S * 9/2018 Lucas ..... D24/207
D845,582 S * 4/2019 Carzola ..... D2/600
D903,885 S * 12/2020 Hamaguchi ..... D24/206
10,893,711 B1 * 1/2021 Davis ..... A61F 7/02
11,058,573 B2 * 7/2021 Fulbrook ..... A61F 7/02
2002/0052566 A1 * 5/2002 Sequeira ..... A61F 7/02 601/112
2005/0049661 A1 * 3/2005 Koffroth ..... A61F 7/10 607/108
2005/0087574 A1 * 4/2005 Butler ..... A45F 3/20 224/148.5
2005/0177925 A1 * 8/2005 Peeples ..... A41D 23/00 2/321
2007/0213794 A1 * 9/2007 Lauver ..... A61F 7/10 607/109
2008/0289351 A1 * 11/2008 Taylor ..... A41D 13/0053 607/109
2009/0036960 A1 * 2/2009 Blair ..... A61F 7/10 607/109
2009/0120126 A1 * 5/2009 Mew ..... A61F 7/10 62/530
2009/0127250 A1 * 5/2009 Chang ..... H05B 3/342 219/529
2011/0079225 A1 * 4/2011 Vole ..... A61M 15/08 128/206.24
2012/0296402 A1 * 11/2012 Kotter ..... A61F 7/10 607/108
2013/0061370 A1 * 3/2013 Ezell ..... A41D 23/00 607/109
2013/0180974 A1 * 7/2013 Wilson ..... A41D 23/00 219/211
2013/0198934 A1 * 8/2013 Marquez ..... A41D 23/00 2/171
2013/0296986 A1 * 11/2013 Dukes ..... A61F 7/10 607/108
2014/0026292 A1 * 1/2014 Wosu ..... A41D 23/00 2/207
2014/0058486 A1 * 2/2014 Moore, Jr. ..... A61F 7/10 607/112
2014/0096302 A1 * 4/2014 De Ricco ..... A41D 23/00 2/69
2015/0173569 A1 * 6/2015 Griggs ..... A61F 7/08 15/209.1
2017/0100279 A1 * 4/2017 Ott ..... A61F 7/02
2017/0303607 A1 * 10/2017 Iser ..... A41D 31/32
2020/0146890 A1 * 5/2020 Smith ..... A61F 9/04
2020/0329795 A1 * 10/2020 Rhodes ..... A41D 13/0058
2020/0337892 A1 * 10/2020 Timms ..... A61F 7/10
2020/0404987 A1 * 12/2020 Betkowski ..... A41D 1/005
2021/0113366 A1 * 4/2021 Roberts ..... A61F 7/02

* cited by examiner

PERSONAL TEMPERATURE REGULATION DEVICE

BACKGROUND

Many efforts have been made to provide a personal temperature regulation device that is effective and comfortable for a user during hot weather or cold weather. Some such personal temperature regulation devices rely on complicated mechanical systems to cool or heat and pump a heat exchange fluid, thereby adding unnecessary weight. Passive personal temperature regulation devices suffer from being bulky or are otherwise cumbersome to wear while a person is performing an activity, such as running or playing sports.

SUMMARY

A first aspect of the disclosure provides a tubular collar. The tubular collar comprises a first sheet with a first curvilinear concave top, a first curvilinear convex bottom, and first and second tapered ends. The first sheet comprising an opening positioned between the first and second tapered ends. The first sheet comprising a first fastener positioned on the first tapered end. The tubular collar further comprises a second sheet with a second curvilinear concave top affixed to the first curvilinear concave top, a second curvilinear convex bottom affixed to the first curvilinear convex bottom, a third tapered end affixed to the first tapered end, and a fourth tapered end affixed to the second tapered end. A second fastener positioned on one of the fourth tapered end.

In some implementations of the first aspect of the disclosure, the first fastener is releasably attachable to the second fastener such that the tubular collar is configurable between an open configuration and a closed configuration.

In some implementations of the first aspect of the disclosure, in the closed configuration, the first fastener is attached to the second fastener and the tubular collar forms a loop sized to be placed around the neck of an individual.

In some implementations of the first aspect of the disclosure, a first distance between the first curvilinear concave top and the first curvilinear convex bottom is greater than a second distance between the second curvilinear concave top and the second curvilinear convex bottom, thereby forming an enclosed cavity.

In some implementations of the first aspect of the disclosure, the opening provides access to the enclosed cavity through the first sheet.

In some implementations of the first aspect of the disclosure, the opening is configurable between an open and closed configuration.

In some implementations of the first aspect of the disclosure, the opening comprises a fastener selected from the group consisting of: a zipper, a fold, a flap, a button, and a hook and pile cloth.

In some implementations of the first aspect of the disclosure, the tubular collar is adapted to receive and maintain a cooling or heating medium in the enclosed cavity via the opening.

In some implementations of the first aspect of the disclosure, the tubular collar further comprises an insert sized and shaped to be maintained within the enclosed cavity.

In some implementations of the first aspect of the disclosure, the insert comprises an opening adapted to receive and maintain a cooling or heating medium within the insert.

In some implementations of the first aspect of the disclosure, the first sheet is affixed to the second sheet by one or more of: stitching, stapling, gluing, adhering, welding, fusing, and molding.

In some implementations of the first aspect of the disclosure, the first and/or second sheet are a liquid permeable material.

In some implementations of the first aspect of the disclosure, the liquid permeable material is selected from the group of liquid permeable materials consisting of: neoprene, wool, nylon, polyester, fleece, silk, hemp, cotton, rayon, open cell foam, open cell rubber, closed cell foam, closed cell rubber, and a blend comprising any one or more of the group of liquid permeable materials.

In some implementations of the first aspect of the disclosure, the first sheet is thicker than the second sheet.

In some implementations of the first aspect of the disclosure, the first sheet has a lower thermal conductivity than the second sheet.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1A:
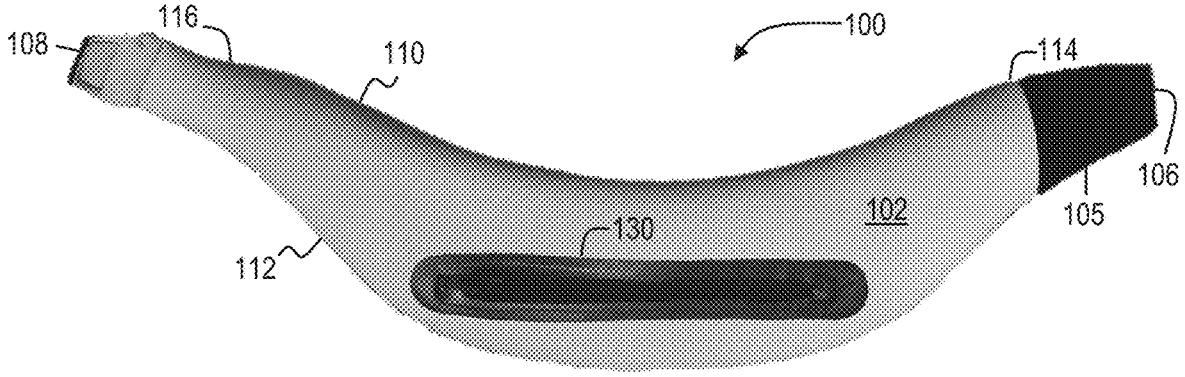
FIG. 1A is a front view of a tubular collar suitable for implementing the several embodiments of the disclosure.

It should be understood at the outset that although illustrative implementations of one or more embodiments are illustrated below, the disclosed systems and methods may be implemented using any number of techniques, whether currently known or in existence. The disclosure should in no way be limited to the illustrative implementations, drawings, and techniques illustrated below, but may be modified within the scope of the appended claims along with their full scope of equivalents. Use of the phrase "and/or" indicates that any one or any combination of a list of options can be used. For example, "A, B, and/or C" means "A", or "B", or "C", or "A and B", or "A and C", or "B and C", or "A and B and C".

Although the embodiments of the tubular collar and corresponding parts thereof consist of certain geometrical configurations as explained and illustrated herein, not all of these components and geometries are essential and thus should not be taken in their restrictive sense. It is to be understood, as also apparent to a person skilled in the art, that other suitable components and cooperation thereinbetween, as well as other suitable geometrical configurations, may be used for the tubular collar, as will be briefly explained herein and as can be easily inferred herefrom by a person skilled in the art. Moreover, it will be appreciated that positional descriptions such as "above", "below", "left", "right" and the like should, unless otherwise indicated, be taken in the context of the figures and should not be considered limiting.

Moreover, it will be appreciated that positional descriptions such as "top", "bottom", "upper", "lower", "above", "below", "forward", "rearward" "left", "right" and the like should, unless otherwise indicated, be taken in the context of the figures and correspond to the position and orientation of the tubular collar and corresponding parts. Positional descriptions should not be considered limiting.

To provide a more concise description, some of the quantitative expressions given herein may be qualified with the term "about". It is understood that whether the term "about" is used explicitly or not, every quantity given herein is meant to refer to an actual given value, and it is also meant to refer to the approximation to such given value that would reasonably be inferred based on the ordinary skill in the art, including approximations due to the experimental and/or measurement conditions for such given value.

In the following description, the term "about" means within an acceptable error range for the particular value as determined by one of ordinary skill in the art, which will depend in part on how the value is measured or determined, i.e. the limitations of the measurement system. It is commonly accepted that a 10% precision measure is acceptable and encompasses the term "about".

The personal temperature regulation device presented herein is a tubular collar adapted to be worn around the neck of an individual. The tubular collar has a front sheet and a rear sheet. A first end of the tubular collar has a first fastener and a second end of the tubular collar has a second fastener, the first and second fasteners adapted to releasably attach to one another. The tubular collar is configurable in an open configuration and a closed configuration. In the open configuration, the first and second fasteners are not attached and the tubular collar has a saddle- or an ox-yoke-shape when laid flat. In the closed configuration, the first and second fasteners are attached to each other to affix the first end to the second end of the tubular collar. In the closed configuration, the tubular collar forms a loop sized to be placed around the neck of an individual. The tubular collar comprises an opening on the front sheet positioned between the first and second ends. The opening is sized to receive ice or other cooling medium, or in some implementations a heating medium, within an enclosed space of the tubular collar.

By positioning the tubular collar around the neck of the individual, the weight of the cooling or heating medium is distributed across the neck and shoulders of the individual. For example, in use, the weight of the tubular collar is distributed across and forward of the trapezius of the individual. The weight of the cooling or heating medium contained in the tubular collar is about equal (e.g., within 10%) on each half of the tubular collar. Therefore, the tubular collar optimizes the weight distribution for comfort during motion and is comfortable to wear during strenuous activities (e.g., running, playing sports, etc.).

Additionally, positioning the tubular collar around the neck of the individual allows for the cooling or heating medium to efficiently regulate body temperature. For example, in a cooling implementation, cooling is provided in close proximity to the carotid arteries, thereby maximizing heat exchange between blood flow of the individual and the tubular collar. Also, when ice is used as the cooling medium, melt water flows from the neck to provide core body cooling. In a heating implementation, the close proximity of the heating medium to the neck allows heat to flow from the device to the neck to provide body warming.

Figure 1B:
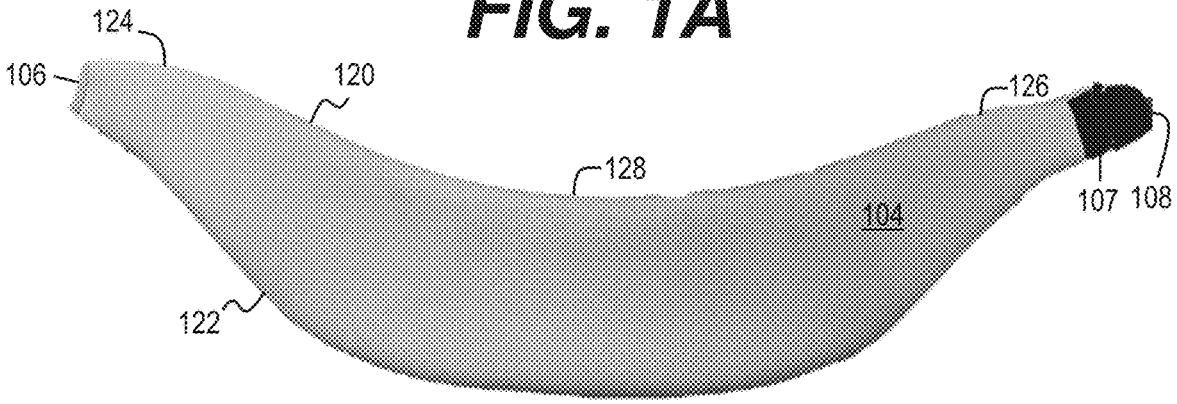
FIG. 1B is a rear view of the tubular collar suitable for implementing the several embodiments of the disclosure.

FIGS. 1A-1B are a front and rear view of a tubular collar 100 suitable for implementing the several embodiments of the disclosure. The tubular collar 100 comprises a front sheet 102, a rear sheet 104, a first end 106, and a second end 108.

The rear sheet 104 provides for thermal communication between a cooling or heating medium contained within the tubular collar 100 (e.g., ice, gel pack, chemical cooling or heating element, etc.) and the skin of an individual wearing the tubular collar 100. In various implementations, the rear sheet 104 or the front and rear sheets 102, 104 are fluid permeable sheets. Accordingly, when filled with ice, meltwater is permitted to flow from the tubular collar 100 and cool the neck and torso of an individual. In some implementations, the rear sheet 104 is made of a neoprene or neoprene blend material. Other materials are contemplated by this disclosure, such as wool, nylon, polyester (including fleece), silk, hemp, cotton, rayon, open or closed cell foams or rubbers, blends comprising any one or more of these materials, or any other liquid permeable material. In some implementations, the front and rear sheets 102, 104 are made of a liquid-tight material or have a liquid tight liner, such as a plastic sheet, to maintain meltwater and/or condensation within the tubular collar 100.

In some implementations, the front sheet 102 is made of the same material as the rear sheet 104. In some implementations, the front sheet is made of a different material than the rear sheet 104. The front and rear sheets 102, 104 may be the same or different thicknesses. The front sheet 102 may have a lower thermal conductivity than the second sheet. In an example, the rear sheet 104 is thinner than the front sheet 102 to encourage greater heat exchange of the cooling or heating medium with the skin of an individual wearing the tubular collar 100 than to the surrounding ambient environment. In some implementations, the front sheet 102 may comprise a thermal barrier, such as a mylar sheet or other thermal barrier to reduce heat exchange between the cooling or heating medium and the surrounding ambient environment.

The pending disclosure contemplates the tubular collar 100 may have any combination of fluid permeability, material, thermal barrier, liner, or thickness discussed above.

In the example shown, a first fastener 105 is positioned on the first end 106 of the front sheet 102 and a second fastener 107 is positioned on the second end 108 of the rear sheet 104 of the tubular collar 100. More generally, the first and second fasteners 105, 107 are positioned on opposite ones of the front and rear sheets 102, 104 and on opposite ones of the first and second ends 106, 108. In some implementations, the first and second fasteners 105, 107 are both positioned on one of the front or rear sheet 102, 104. The first fastener 105 is configured to releasably attach to the second fastener 107. Therefore, the tubular collar 100 is configurable in an open configuration in which the first and second fasteners 105, 107 are not attached and a closed configuration in which the first and second fasteners 105, 107 are attached.

In the examples shown in FIGS. 1A-1B, the tubular collar 100 is in the open configuration (e.g., the first and second fasteners 105, 107 are not attached) and one of the front or rear sheets 102, 104 are placed upon a flat surface. A top 110 of the front sheet 102 and a bottom 112 of the front sheet 102 have a curvilinear saddle shape or ox-yoke shape, including a first ridge 114 on the first end 106, a second ridge 116 on the second end 108 and a parabolic arc or valley 118 therebetween. Likewise, a top 120 of the rear sheet 104 and a bottom 122 of the rear sheet 104 have a curvilinear saddle shape or ox-yoke shape, including a first ridge 124 on the first end 106, a second ridge 126 on the second end 108 and a parabolic arc or valley 128 therebetween. That is, the tops 110, 120 of the front and rear sheets 102, 104 have a curvilinear concave shape, whereas the bottoms 112, 122 of the front and rear sheets 102, 104 have a curvilinear convex shape.

As shown, each of the first and second ends 106, 108 are tapered with respect to a mid-point of the tubular collar 100 between the first and second ends 106, 108. That is, a distance between the tops 110, 120 and bottoms 112, 122 of the front and rear sheets 102, 104 is less at the first and second ends 106, 108 (e.g., 30-70% less) than at the mid-point of the tubular collar 100.

In the example shown, the first and second fasteners 105, 107 are hook and pile cloth. For example, the first fastener 105 is pile cloth and the second fastener 107 is hook cloth. Accordingly, the second fastener 108 is adapted to releasably attach to the first fastener 106. In another example, the first fastener 105 is hook cloth and the second fastener 107 is pile cloth. The first fastener 105 extends a first length along the front sheet 102 in a direction from the first end 106 towards the second end 108. The second fastener 107 extends a second length along the rear sheet 104 in a direction from the second end 108 towards the first end 106. The first fastener 105 also extends along a first height between the top 110 and bottom 112 of the front sheet 102. The second fastener 107 also extends along a second height between the top 110 and bottom 112 of the front sheet 102.

In the example shown, the first and second height fill the space between the top 110 and bottom 112 of the front sheet 102. In other examples, the first and/or second height may be less than the space between the top 110 and bottom 112 of the front sheet 102.

As shown, the first length of the first fastener 105 is longer than the second length of the second fastener 107. The additional length provide by the first fastener 105 facilitates adjustability of the tubular collar 100 around the neck of an individual. That is, a size of the loop formed in the closed configuration of the tubular collar 100 may be adjusted based upon where the first fastener 105 is attached along the second length of the second fastener 107. In some implementations, the first length and the second length are the same length to thereby further increase the adjustability of the tubular collar 100. In some examples, the first and second length are between 1 and 5 inches long. In a specific example, the first and second length are about (e.g., within 10%) 3 inches long.

While the above example is described with the first and second fasteners 105, 107 as hook and pile cloth, other fasteners are contemplated by this disclosure. For example, the first and second fasteners 105, 107 may be a clasp, buckle, button, snap, or any other releasably attachable fastener.

An opening 130 is positioned on the front sheet 102 between the first and second ends 106, 108 and sized to receive a cooling or heating medium. In various implementations, the opening 130 is an elongated shape extending in a longitudinal direction (e.g., in a direction of the longest dimension) of the tubular collar 100. In various implementations, a length of the opening is between 20-50% of a length of the tubular collar 100. The opening 130 is closable so as to maintain the cooling or heating medium within the tubular collar 100 upon insertion through the opening 130. In the example shown, the opening 130 comprises a zipper to facilitate opening and closing the opening 130. Other opening mechanisms are contemplated by this disclosure, such as a fold, a flap, a button, hook and pile cloth, or any other such mechanism for opening and closing the opening 130.

In the example shown, the opening 130 is positioned on a lower portion (e.g., positioned on a side of a mid-point between the top 110 and bottom 112 of the front sheet 102 farther away from the first and second ridges 114, 116) of the front sheet 102. In some implementations, the opening 130 may be positioned on an upper portion (e.g., positioned on a side of a mid-point between the top 110 and bottom 112 of the front sheet 102 closer to the first and second ridges 114, 116) of the front sheet 102. Other locations and orientations of the opening 130 are contemplated by this disclosure.

Figure 2:
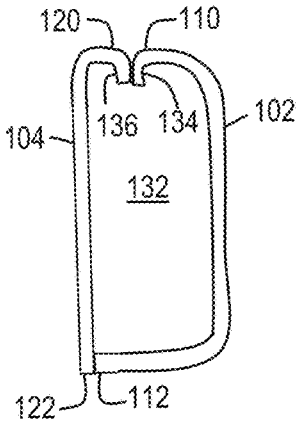
FIG. 2 is a cross-sectional view of the tubular collar suitable for implementing the several embodiments of the disclosure.

FIG. 2 is a cross-sectional view of the tubular collar 100 suitable for implementing the several embodiments of the disclosure. Like features described above are identified by like reference numerals. As shown, the front sheet 102 is longer than the rear sheet 104, thereby forming an enclosed cavity 132 within which to maintain the cooling or heating medium. The cavity 132 has a generally D-shaped cross section. In various implementations, the front sheet 102 is between 5-50% longer than the rear sheet 104. A larger cavity 132 is formed by having a longer front sheet 102.

Figure 3A:
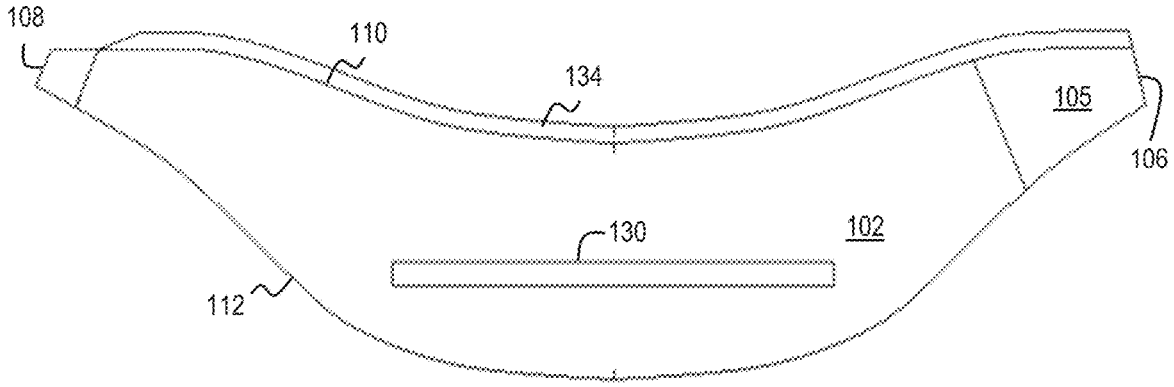
FIG. 3A is a fabric pattern for a front sheet of the tubular collar suitable for implementing the several embodiments of the disclosure.
Figure 3B:
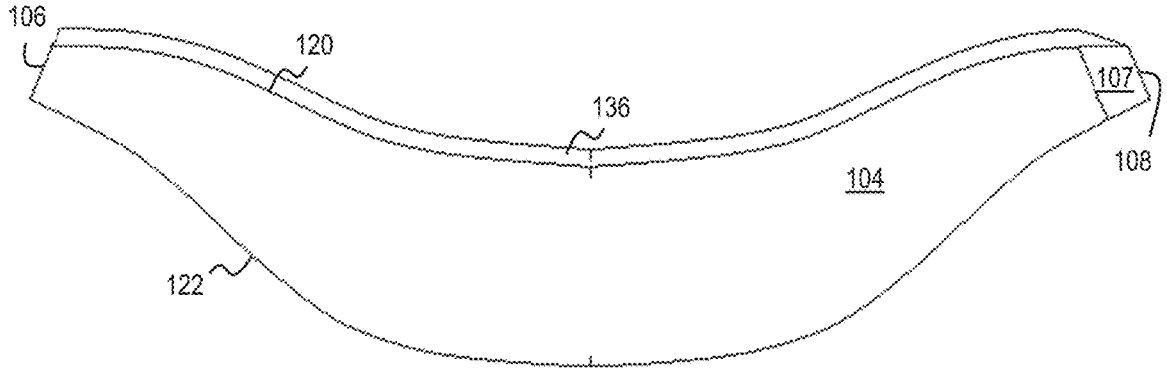
FIG. 3B is a fabric pattern for a rear sheet of the tubular collar suitable for implementing the several embodiments of the disclosure.

FIGS. 3A-3B are fabric patterns for the front and rear sheets 102, 104 of the tubular collar 100 suitable for implementing the several embodiments of the disclosure. Like features described above are identified by like reference numerals. In addition to the features described above, the fabric patterns show a first seam 134 (e.g., an additional length of the front sheet 102 that extends beyond the top 110) that runs along the top 110 of the front sheet 102. Likewise, the fabric patterns show a second seam 136 (e.g., an additional length of the rear sheet 104 that extends beyond the top 120) that runs along the top 120 of the rear sheet 104.

As shown in FIG. 2, when the tubular collar 110 is constructed, the first seam 134 and the second seam 136 overlap to join the top 110 of the front sheet 102 to the top 120 of the rear sheet 104 (e.g., an inverted overlapping seam). The first seam 134 and the second seam 136 may be affixed to each other by stitching, stapling, gluing, adhering, welding, fusing, or molding the front sheet 102 to the rear sheet 104. Any other method of affixing the first seam 134 to the second seam 136 are contemplated by this disclosure. Likewise, the bottom 112 of the front sheet 102 may be affixed to the bottom 122 of the rear sheet 104 using any of the methods described above or known to those of ordinary skill in the art. While a seam is not shown for the bottom 112 of the front sheet 102 and the bottom 122 of the rear sheet 104, in various implementations respective seams may be provided on the bottoms 112, 122 of the front and rear sheets 102, 104 as well.

Figure 4:
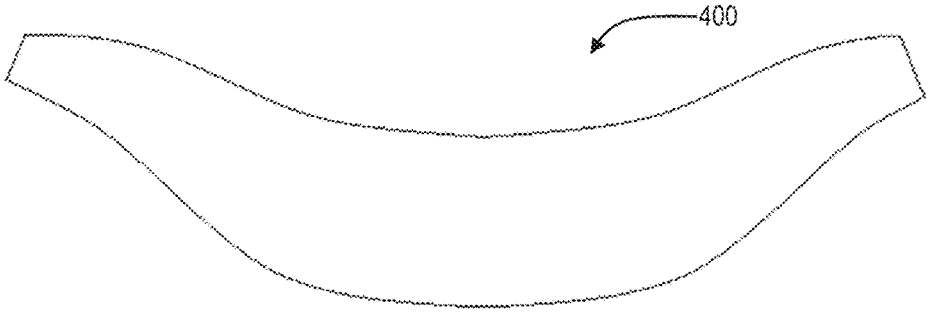
FIG. 4 is a front view of an insert for the tubular collar suitable for implementing the several embodiments of the disclosure.

FIG. 4 is a front view of an insert 400 for the tubular collar 100 suitable for implementing the several embodiments of the disclosure. The insert 400 is sized and shaped to be received within the cavity 132 of the tubular collar 100. In various implementations, the insert 400 may be a plastic bag or other flexible container for maintaining the cooling or heating medium therein. Therefore, meltwater or condensation from the cooling medium or warm water from the heating medium is contained within the insert 400. In some implementations, the insert 400 may be filled with a gel material or other phase change material to provide the cooling medium for the tubular collar 100 when ice is not readily available or desired. In some implementations, the insert 400 may be filled with a device that uses exothermic chemical reactions to provide a heating medium when hot water is not available or desired.

In various implementations, a heating medium may be used in the tubular collar 100. Such a heating medium may be used for winter sport activities. For example, the heating medium may be a supercooled wax contained within the insert 400 which releases the latent heat of freezing upon initiation of nucleation. The heating medium may be hot water contained within the insert. The heating medium may also be provided by an exothermic chemical reaction. Other heat packs and heating medium are contemplated by this disclosure.

Figure 5:
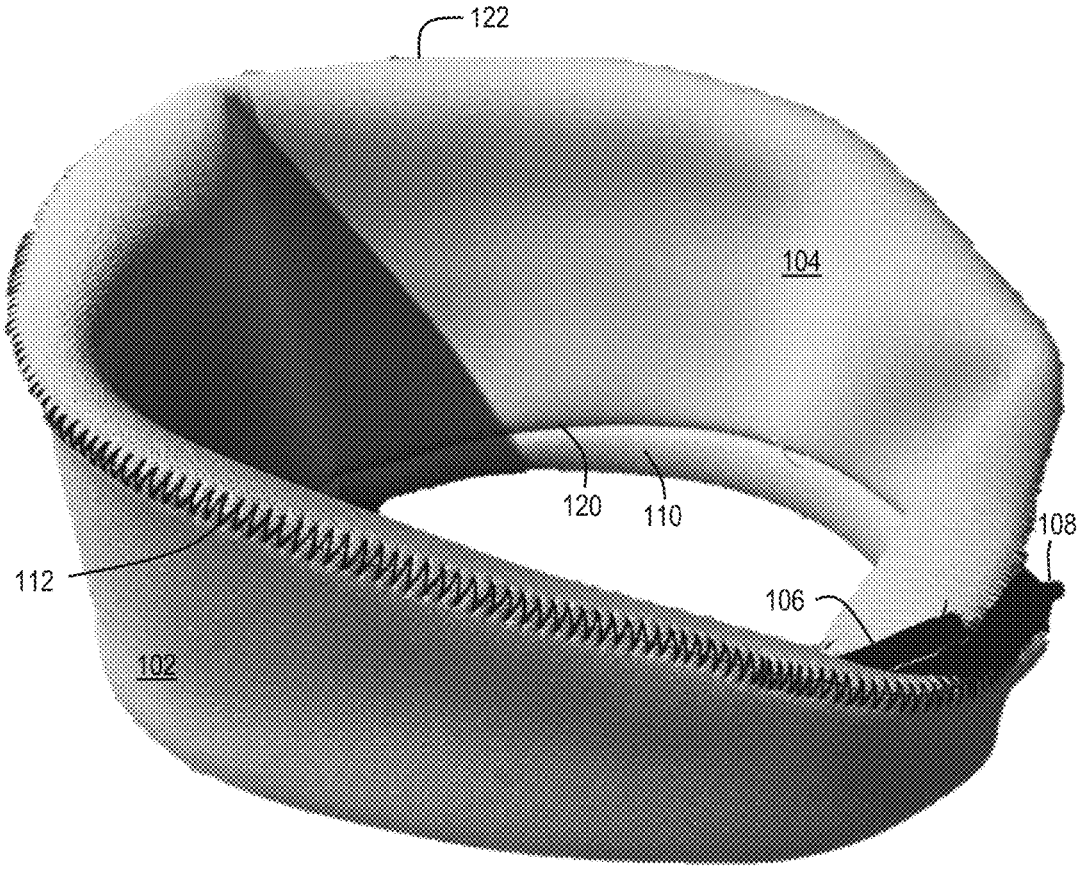
FIG. 5 is a perspective view of the tubular collar in the closed configuration suitable for implementing the several embodiments of the disclosure.

FIG. 5 is a perspective view of the tubular collar 100 in the closed configuration suitable for implementing the several embodiments of the disclosure. Like features described above are identified by like reference numerals. In the example shown, the first and second fasteners 105, 107 are affixed to one another such that the first and second ends 106, 108 are coupled together such that the tubular collar forms a loop sized and shaped to fit around the neck of an individual. The tops 110, 120 of the first and second sheets 102, 104 are adapted to rest upon the shoulders and neck of an individual, while the bottoms 112, 122 of the first and second sheets 102, 104 extend up the neck of the individual towards the top of their head. In another example, the bottoms 112, 122 of the first and second sheets 102, 104 are adapted to rest upon the shoulders and neck of an individual, while the tops 110, 120 of the first and second sheets 102, 104 extend up the neck of the individual towards the top of their head. In either orientation, positioning the tubular collar around and up the neck of the individual allows for the cooling medium to efficiently cool the body. For example, cooling is provided in close proximity to the carotid arteries, thereby maximizing heat exchange between blood flow of the individual and the tubular collar 100, and by extension to the cooling medium maintained therein. Also, when ice is used as the cooling medium, melt water flows from the neck to provide core body cooling to the torso. In an implementation where the device is used for heating, the close proximity to the carotid arteries and neck provide heat exchange from the device to the body.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A tubular collar, comprising:

a first sheet with a first curvilinear concave top, a first curvilinear convex bottom, and first and second tapered ends, the first sheet comprising an opening positioned between the first and second tapered ends, and the first sheet comprising a first fastener positioned on the first tapered end or the second tapered end, wherein the first and second tapered ends are tapered in a direction away from the opening; and a second sheet with a second curvilinear concave top affixed to the first curvilinear concave top, a second curvilinear convex bottom affixed to the first curvilinear convex bottom, a third tapered end affixed to the first tapered end, and a fourth tapered end affixed to the second tapered end, a second fastener positioned on the third tapered end or the fourth tapered end, wherein the third and fourth tapered ends are tapered in a direction away from a mid-point of the second sheet, wherein at across-section of the tubular collar where the first sheet is affixed to the second sheet, a length of the first sheet between the first curvilinear concave top and the first curvilinear convex bottom is greater than a length of the second sheet between the second curvilinear concave top and the second curvilinear convex bottom, thereby forming an enclosed cavity, wherein the opening provides access to the enclosed cavity through the first sheet, wherein the tubular collar is adapted to receive and maintain a heat transfer medium in the enclosed cavity via the opening, wherein a cross-sectional area of the enclosed cavity is tapered in a direction away from the opening, wherein the first fastener is releasably attachable to the second fastener such that the tubular collar is configurable between an open configuration and a closed configuration, and wherein in the closed configuration, the first fastener is attached to the second fastener and the tubular collar forms a loop sized to be placed around the neck of an individual.

2. The tubular collar of claim 1, wherein the opening is configurable between an open and closed configuration.

3. The tubular collar of claim 2, wherein the opening comprises a fastener selected from the group consisting of: a zipper, a fold, a flap, a button, and a hook and pile cloth.

4. The tubular collar of claim 1, wherein the tubular collar is adapted to receive and maintain a cooling medium in the enclosed cavity via the opening.

5. The tubular collar of claim 1, wherein the tubular collar is adapted to receive and maintain a heating medium in the enclosed cavity via the opening.

6. The tubular collar of claim 1, further comprising an insert sized and shaped to be maintained within the enclosed cavity.

7. The tubular collar of claim 6, wherein the insert comprises an opening adapted to receive and maintain a cooling medium within the insert.

8. The tubular collar of claim 6, wherein the insert comprises an opening adapted to receive and maintain a heating medium within the insert.

9. The tubular collar of claim 1, wherein the first sheet is affixed to the second sheet by one or more of: stitching, stapling, gluing, adhering, welding, fusing, and molding.

10. The tubular collar of claim 1, wherein the first and/or second sheet are a liquid permeable material.

11. The tubular collar of claim 10, wherein the liquid permeable material is selected from the group of liquid permeable materials consisting of: neoprene, wool, nylon, polyester, fleece, silk, hemp, cotton, rayon, open cell foam, open cell rubber, closed cell foam, closed cell rubber, and a blend comprising any one or more of the group of liquid permeable materials.

12. The tubular collar of claim 1, wherein the first sheet is thicker than the second sheet.

13. The tubular collar of claim 1, wherein the first sheet has a lower thermal conductivity than the second sheet.

14. The tubular collar of claim 1, wherein the heat transfer medium is ice and at least one of the first sheet or the second sheet are liquid permeable to permit a flow of meltwater from the tubular collar.

15. The tubular collar of claim 14, wherein in the closed configuration the first and second curvilinear concave tops are adapted to rest upon the shoulders and neck of the individual while the first and second curvilinear convex bottoms extend up the neck of the individual.

16. The tubular collar of claim 1, wherein the enclosed cavity extends to the first fastener and the second fastener.

17. A tubular collar, comprising:

a first sheet with an ox-yoke shape including a first curvilinear concave top, a first curvilinear convex bottom, and first and second ends, the first sheet comprising an opening positioned between the first and second ends, and the first sheet comprising a first fastener positioned at the first end or the second end, wherein the first sheet is tapered in a direction from the opening to the first and second ends, wherein the first curvilinear concave top includes a first ridge on the first end, a second ridge on the second end, and a parabolic arc therebetween;

a second sheet with an ox-yoke shape including a second curvilinear concave top affixed to the first curvilinear concave top, a second curvilinear convex bottom affixed to the first curvilinear convex bottom, a third end affixed to the first end, and a fourth end affixed to the second end, a second fastener positioned at the third end or the fourth end, wherein the second sheet is tapered in a direction from a mid-point of the second sheet to the third and fourth ends, wherein the second curvilinear concave top includes a third ridge on the third end, a fourth ridge on the fourth end, and a second parabolic arc therebetween, wherein the first sheet and the second sheet are affixed together to form an enclosed cavity, wherein the opening provides access to the enclosed cavity through the first sheet, wherein the tubular collar is adapted to receive and maintain a heat transfer medium in the enclosed cavity via the opening, wherein a cross-sectional area of the enclosed cavity is tapered in a direction away from the opening, wherein the first fastener is releasably attachable to the second fastener such that the tubular collar is configurable between an open configuration and a closed configuration, wherein in the closed configuration, the first fastener is attached to the second fastener and the tubular collar forms a loop sized to be placed around the neck of an individual such that the first and second curvilinear concave tops are adapted to rest upon the shoulders and neck of the individual while the first and second curvilinear convex bottoms extend up the neck of the individual, wherein a cross-sectional distance between where the second curvilinear concave top is affixed to the first curvilinear concave top and where the second curvilinear convex bottom is affixed to the first curvilinear convex bottom is least at the first and second fasteners and increases in a direction away from the first and second fasteners.

18. The tubular collar of claim 17, wherein in the closed configuration, the second sheet is configured to contact the skin of the individual, wherein the second sheet is thinner than the first sheet.

19. The tubular collar of claim 17, wherein the heat transfer medium is ice and at least one of the first sheet or the second sheet are liquid permeable to permit a flow of meltwater from the tubular collar.

20. The tubular collar of claim 17, wherein the enclosed cavity extends to the first fastener and the second fastener, and wherein in the closed configuration, the enclosed cavity is configured to be positioned to provide heat exchange between the heat transfer medium and the carotid arteries of the individual.

* * * * *